United States Patent [19]

Smith

[11] 4,427,248

[45] Jan. 24, 1984

[54] SPRING LOADED SHIELD BOND CONNECTOR

[75] Inventor: Donald J. Smith, Woodland Hills, Calif.

[73] Assignee: Communications Technology Corporation, Los Angeles, Calif.

[21] Appl. No.: 322,081

[22] Filed: Nov. 17, 1981

[51] Int. Cl.[3] ..... H01R 4/24; H01R 4/66

[52] U.S. Cl. ..... 339/14 R; 339/95 R

[58] Field of Search ..... 339/14 R, 14 L, 95 R, 339/97 R; 174/88 C, 88 S, 78

[56] References Cited

U.S. PATENT DOCUMENTS 3,778,749 12/1973 Kapell ..... 174/78 X 4,195,895 4/1980 Ziegler ..... 339/95 R X

FOREIGN PATENT DOCUMENTS 2203946 8/1973 Fed. Rep. of Germany .

*Primary Examiner*—Eugene F. Desmond

*Attorney, Agent, or Firm*—Harris, Kern, Wallen & Tinsley

[57] ABSTRACT

A connector for making an electrical connection with the metal shield of an electrical cable having a plurality of insulated conductors, an inner metal shield over the conductors, and an outer insulated sheath over the shield. A unitary connector of resilient metal with a central section and opposed outer sections for sliding onto the end of a cable, with the central section between the conductors and shield and with the outer sections overlying the sheath. A plurality of teeth on a tongue of the central section for engaging the shield, and lanced or sheared tips on the outer sections for engaging the sheath.

9 Claims, 5 Drawing Figures

SPRING LOADED SHIELD BOND CONNECTOR

BACKGROUND OF THE INVENTION

This invention relates to a bonding device for making an electrical connection to the conducting shield of an electrical cable, and in particular to a new and improved one piece bonding connector which can be applied by simply pushing it onto the cable.

The connector of the present invention is intended for use with an electrical cable having a plurality of insulated conductors enclosed by an inner metal shield which in turn is enclosed by an outer insulating sheath. An additional paper liner may be provided between the insulated conductors and the metal shield. Such cables are widely used in the telephone industry and the connector of the present invention is especially adapted for use with telephone cables.

A variety of configurations have been provided in the past for making connections to the shield of a cable. Such devices are shown in U.S. Pat. Nos. 3,777,049; 3,915,540; 3,963,299; and 4,026,619. Additional cable shield bonding devices are shown in copending applications of Mangrobang et al, U.S. Ser. No. 066,780 filed Aug. 14, 1979, Kund U.S. Ser. No. 125,586 filed Feb. 28, 1980, and Kund U.S. Ser. No. 148,811, filed May 12, 1980, all assigned to the same Assignee as the present application. Another form of connector is shown in German Offenlegungsschrift No. 2,203,946. These various prior connecting devices are suitable for various uses but are not so satisfactory for other uses.

Some of the prior connectors require a bolt or stud and nut for making the connection. Some of the prior connectors require splitting or opening up of the shield and sheath in order to make the electrical connection. Some of the prior connectors require the application of force with some form of tool to compress the connector and shield together. Temperature cycling is always a problem with electrical connections to the shield of a cable having an insulating sheath over the shield. The plastic insulating material flows under pressure as temperature changes. Both the plastic sheath and metal shield have a tendency to move during temperature cycling. All of this causes the contact resistance between the connector and the shield to increase.

It is an object of the present invention to provide a new and improved electrical connector which is formed in one piece, without requiring bolts and nuts or other forms of fasteners. A further object is to provide such a connector which may be installed without requiring compression forces or a compression tool, by merely pushing the connector into position. An additional object is to provide such a connector which can be utilized without requiring splitting or opening up of the cable sheath and shield.

It is a particular object of the invention to provide a new and improved connector with a resilient or spring like construction which makes electrical contact with the metal shield with a minimum initial pressure on the sheath and shield, and one which will continue to provide relatively low electrical contact resistance during ambient temperature changes.

Other objects, advantages, features and results will more fully appear in the course of the following description.

SUMMARY OF THE INVENTION

A connector for making an electrical connection with the metal shield of an electrical cable having a plurality of insulated conductors, an inner metal shield over the conductors, and an outer insulating sheath over the shield. The cable may also have a paper layer between the conductors and the metal shield. The preferred form of the connector is a unitary metal piece having a central section and opposed outer sections joined to the central section, with the outer sections generally parallel to and spaced from the central section. The central section has a tongue carrying a plurality of teeth, with the teeth directed upward toward the outer sections, and with the tongue adapted for sliding into the cable between the conductors and shield with the teeth engaging the shield and with the outer sections overlying the sheath.

The connector preferably is formed of a resilient material with the outer sections spaced from the central section a distance less than the thickness of the sheath and shield to provide a compression force on the sheath and shield when the connector is pushed into position on the cable.

The teeth of the tongue preferably have a height which increases with successive teeth in the direction of the junction of the central and outer sections, and with the teeth having a rake with the tips inclined towards the junction, and with the teeth in two spaced rows. The inner edges of the outer sections preferably are lanced to provide downwardly projecting tips directed towards the junction of the central and outer sections. With this construction, the lanced tips engage the outer sheath and the teeth engage the inner shield providing a resilient electrical engagement and resistance to removal.

DESCRIPTION OF THE PREFERRED EMBODIMENT

Figure 1:
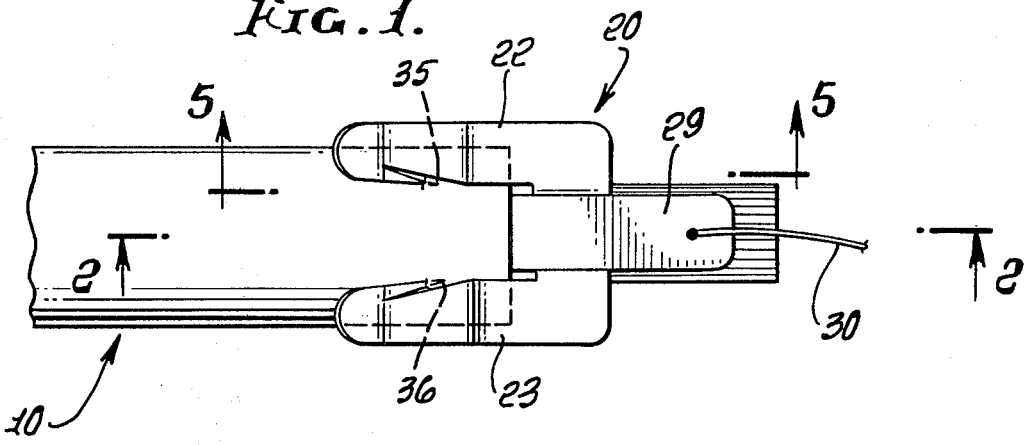
FIG. 1 is a top view of a portion of an electrical cable with an electrical connector incorporating the presently preferred embodiment of the invention mounted thereon.
Figure 2:
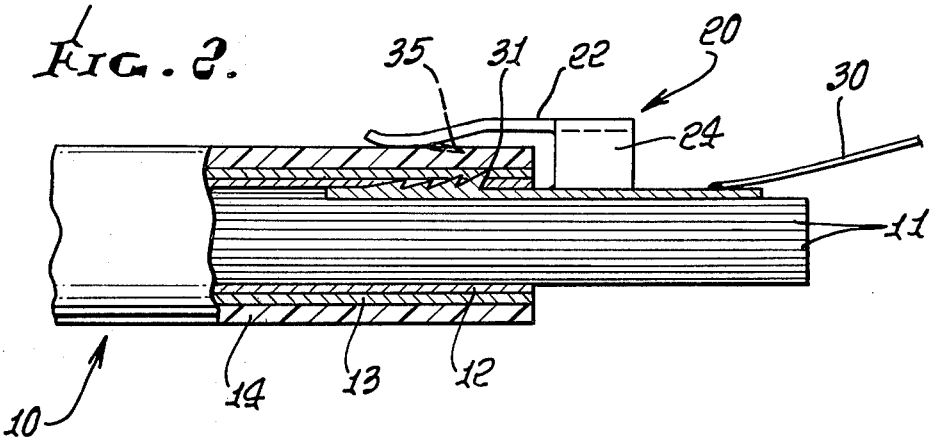
FIG. 2 is a partial sectional view taken along the line 2—2 of FIG. 1.

A typical electrical cable 10 is shown in FIGS. 1 and 2, and includes a plurality of insulated electrical conductors 11, a paper liner 12, a metal shield 13, and a plastic sheath 14. The paper liner 12 is not always utilized, and the connector of the present invention is intended for use with a shielded and sheathed cable with or without the paper liner.

Figure 4:
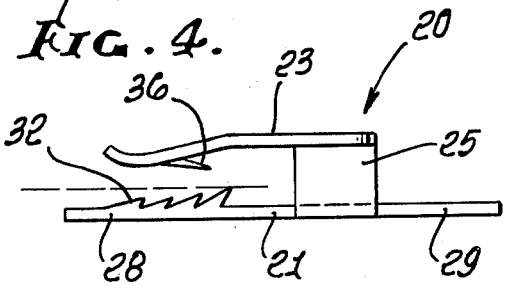
FIG. 4 is a side view of the connector of FIG. 3.
Figure 3:
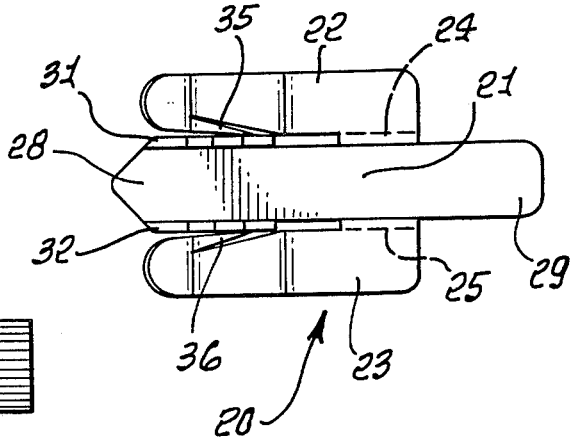
FIG. 3 is a top view of the connector of FIG. 1.
Figure 5:
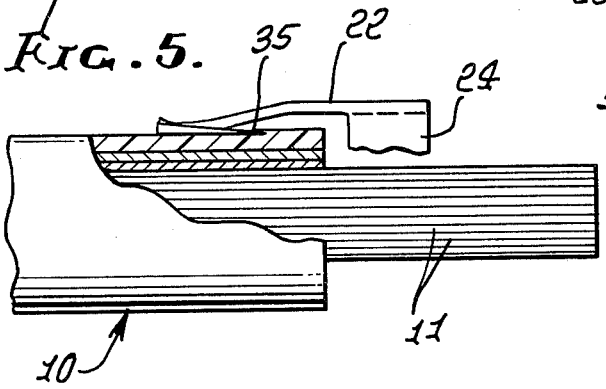
FIG. 5 is a partial sectional view taken along the line 5—5 of FIG. 1.

An electrical connector 20 is shown in FIGS. 3 and 4, including a central section 21 and outer sections 22, 23 joined by arms 24, 25. The outer sections 22, 23 are spaced upward from the central section 21, are generally parallel to the central section, and desirably are curved upward at the ends to facilitate insertion. The central section 21 has a tongue 28 projecting in the same direction as the outer sections 22, 23, and may have a base 29 projecting in the opposite direction for attachment of an electrical conductor 30, as by spot welding or soldering or the like, or may be formed into a lug for direct connection to a ground post.

In the preferred embodiment illustrated, the tongue 28 carries two spaced rows of teeth 31, 32, with the teeth projecting upward towards the outer sections 22, 23. Preferably, the height of successive teeth 32 increases in the direction of the junctions of the central and outer sections formed by the arms 24, 25, as best seen in FIG. 4. Also, the teeth preferably are provided with a rake of about 30° with the tips of the teeth inclined toward the arms 24, 25, also best seen in FIG. 4.

In the preferred configuration, tips 35, 36 are formed along the inner edges of the outer sections 22, 23, typically by lancing or shearing, to form long narrow tips directed toward the arms 24, 25, as best seen in FIGS. 3 and 4.

The connector is formed from a single metal sheet by conventional stamping and bending operations. The connector preferably is formed of a metal which can be made resilient by heat treating so that after the stamping and/or forming is completed, the connector is heat treated to make it resilient. Preferably, the left ends of the outer sections 22, 23, as viewed in the drawing, are bent downward toward the tongue 28 of the central section 21, as seen in FIGS. 2 and 4. The spacing between the tongue of the central section and the bent down portions of the outer sections is chosen to be less than the thickness of the shield and sheath of the cable with which the connector is to be used.

In applying the connector to a cable, the shield and sheath, and the paper layer if present, are cut away, leaving the conductors of the cable exposed, as shown in FIG. 2. This is the only work which needs to be carried out on the cable, and is performed in any event to permit conductor splicing operations. The connector is then pushed onto the cable with the tongue between the conductors 11 and the metal shield 13 (and paper layer if present). This is the only installation step required. The teeth 31, 32 bite into the metal shield 13 providing the desired electrical connection, as shown in FIG. 2. This installation is achieved with a minimum of compression of the plastic sheath. The resilient nature of the connector does provide a compression force urging the teeth into engagement with the metal shield providing the desired electrical contact. The successive increases in height of the teeth provide improved contact with the metal shield and also aid cutting through the paper layer when present. The rake on the teeth and the downwardly lanced tips 35, 36 function to lock the connector in position on the cable and make removal very difficult.

I claim:

1. A screwless connector for making an electrical connection with the metal shield of an electrical cable having a plurality of insulated conductors, an inner metal shield over the conductors, and an outer insulating sheath over the shield, said connector comprising a single unitary metal piece having a central section and opposed outer sections joined to said central section, with said outer sections generally parallel to and spaced upward from said central section and spaced outward on opposite sides of said central section, said central section having a tongue carrying a plurality of teeth, with said teeth directed upward toward said outer sections, with said outer sections having tips directed downward toward said central section, with said tongue adapted for sliding into the cable between the conductors and shield with said teeth engaging the shield and with said outer sections overlying the sheath with said tips engaging the sheath.

2. A connector formed of a resilient material for making an electrical connection with the metal shield of an electrical cable having a plurality of insulated conductors, an inner metal shield over the conductors, and an outer insulating sheath over the shield, said connector comprising a unitary metal piece having a central section and opposed outer sections joined to said central section, with said outer sections generally parallel to and spaced upward from said central section, said central section having a tongue carrying a plurality of teeth, with said teeth directed upward toward said outer sections, with said tongue adapted for sliding into the cable between the conductors and shield with said teeth engaging the shield and with said outer sections overlying the sheath, and with said outer sections spaced from said central section a distance less than the thickness of the sheath and shield to provide a compression force on the sheath and shield when said connector is positioned on the cable.

3. A connector as defined in claim 2 wherein each of said outer sections has inner and outer edges, with a downwardly projecting tip on each of said inner edges and with said tips directed toward the junction of said central and outer sections.

4. A connector as defined in claim 3 wherein the height of successive teeth of said tongue increases in the direction of said junction.

5. A connector as defined in claim 4 wherein said tongue has two spaced rows of said teeth.

6. A connector as defined in claim 4 wherein said teeth have a rake with the tips thereof inclined toward said junction.

7. A connector as defined in claim 1 wherein the height of successive teeth of said tongue increases in the direction of the junction of said central and outer sections.

8. A connector as defined in claim 7 wherein said tongue has two spaced rows of said teeth.

9. A connector as defined in claim 7 wherein said teeth have a rake with the tips thereof inclined toward said junction.

* * * * *